US007350567B2

(12) United States Patent
Stolarczyk et al.

(10) Patent No.: US 7,350,567 B2
(45) Date of Patent: Apr. 1, 2008

(54) INCREASING MEDIA PERMEABILITY WITH ACOUSTIC VIBRATIONS

(76) Inventors: Larry G. Stolarczyk, 848 Clayton Hwy., Raton, NM (US) 87740; Dimitri A. Kas'yanov, 848 Clayton Hwy., Raton, NM (US) 87740

( * ) Notice: Subject to any disclaimer, the term of this patent is extended or adjusted under 35 U.S.C. 154(b) by 69 days.

(21) Appl. No.: 11/255,109

(22) Filed: Oct. 21, 2005

(65) Prior Publication Data

US 2006/0108111 A1 May 25, 2006

Related U.S. Application Data

(60) Provisional application No. 60/629,550, filed on Nov. 22, 2004.

(51) Int. Cl.
*E21B 28/00* (2006.01)
*E21B 43/16* (2006.01)

(52) U.S. Cl. ..... 166/249; 166/177.2

(58) Field of Classification Search ..... 166/249, 166/177.1, 177.2

See application file for complete search history.

(56) References Cited

U.S. PATENT DOCUMENTS 3,416,487 A * 12/1968 Greene ..... 116/137 A
3,756,400 A * 9/1973 Kammori et al. ..... 209/1
3,842,907 A * 10/1974 Baker et al. ..... 166/249
3,848,672 A * 11/1974 Bodine ..... 166/249
3,850,135 A * 11/1974 Galle ..... 116/137 A
5,083,613 A * 1/1992 Gregoli et al. ..... 166/275

* cited by examiner

*Primary Examiner*—Kenneth Thompson
(74) *Attorney, Agent, or Firm*—Richard B. Main

(57) ABSTRACT

A coalbed methane production method comprises acoustic radiators strategically placed within exhaust boreholes that sonically vibrate the immediate wall areas. The gas volume output that can be realized by an exhaust well is mainly determined by the penetrability of the inside faces of the borehole. Such inside faces behave like a filter matrix, and the important areas involved in restricting the gas flow the most are not more than a few diameters away from the exhaust well in the collector zone. Therefore, the more permeable that such immediate area around the exhaust borehole can be made, the higher will be the volume of gas produced. Strong sonic vibrations from the acoustic radiators positioned in a drillstring shake open spaces in the media for the gas to flow out and be collected. The media experiences a type of elastic collapse under the differential pressures that are exerted the strongest near the borehole opening.

8 Claims, 2 Drawing Sheets

INCREASING MEDIA PERMEABILITY WITH ACOUSTIC VIBRATIONS

RELATED APPLICATIONS

This Application claims benefit of U.S. Provisional Patent Application 60/629,550, filed Nov. 22, 2004, and titled INCREASED METHANE PRODUCTION FROM COALBED DEPOSITS BY ACOUSTIC VIBRATION OF EXHAUST WELLS, by the present inventor, Dimitri A. Kas'yanov.

BACKGROUND

1. Field of the Invention

The present invention relates to devices and methods for increasing the permeability of porous and fractured media with acoustic stimulation, and more particularly in once instance to methane and natural gas extraction from coalbed deposits, and acoustic borehole equipment to increases the gas permeability of the media surrounding the borehole inside faces of exhaust wells.

2. Description of the Prior Art

Methane, firedamp, or natural gas, is a normal constituent of every coalbed deposit, and are formed in situ by Nature when the coalbed takes form. Such gases are adsorbed by the coal, e.g., they occupy the particle surface areas over the entire parent coal matrix. The adsorption surface area of coal can be very large, e.g., about one billion square feet per ton of coal. The gas stored in a coalbed can be significantly more than the gas found in a typical and otherwise similarly sized natural gas deposit. Such methane and carbon dioxide do not freely migrate through the coalbed deposits. They have to be induced to release from the coal, e.g., by venting to a lower atmospheric pressure.

In contrast, methane deposited in sand or sandstone is not adsorbed by the sand material itself, and is usually able to flow relatively well through the cavities, cracks, fissures, and spaces between the sand particles.

Every coal deposit includes some amount of methane that can make mining the coal dangerous. As a general rule, the amount of methane adsorbed is proportional to the grade of the coal. The higher the coal grade, the higher will be the gas content. Also, the deeper the coalbed, the higher will be its gas content. The pressure in the coalbed is proportional to its depth, and the degree of gas sorption increases with such pressure. A desorption isotherm can be used to predict the reduction in pressure, for a given temperature, that will be needed to get the gas to desorb and seep out to exhaust well collectors.

Coal beds are very often inundated with ground water. The hydrostatic pressure of such water will add to the total pressure in a coalbed and a concomitant increase in the gas sorption. The desorption isotherm shows an appropriate level of decrease in the hydrostatic pressure needed to recover the methane from the coal.

In the past, the collection methods and equipment needed to harvest the methane from a coalbed simply did not exist. So no profit could be make from the methane. Such methane had always been considered a nuisance because it poisoned the air the miners needed to breath, and thousands of times it has proved to be explosively deadly. Even today, when modern methods and equipment can be employed to great success, serious and frequent mining explosions and disasters continue to occur that could have been avoided if the firedamp had simply been removed before coal mining operations began. These accidents have been especially common recently in the coalmines of Russia and China. But no coal mine in the world is immune.

Methane production ahead of mining has become a widespread way to protect against methane-related accidents and to increase profits by selling off the collected methane. In fact, harvesting the methane from coalbeds or strata too deep or too poor to support profitable coal production is becoming an attractive way to convert hydrocarbon reserves into revenues.

Coalmine gas production holes were once simply used to help ventilate mines and to minimize the coal-production risk due to mine gases. Now, coalmine operations recognize that profits can be made by gas production and sales. Simply releasing the gas into the atmosphere is a waste of money, and contributes to environmental pollution. In the last time, the experience in mine degasification led to development of projects of gas production independent of coalmine operation.

Widely used methods for coalbed gas production include vertical and horizontal boreholes drilled to degasify the deposits before starting coal mine production, vertical gassers in waste rock, and vertical or directionally drilled boreholes independent of any intent to later mine coal. Prior art methods for coal methane production have included injecting a second gas, such as nitrogen, carbon dioxide, or vitiated air into coalbeds to force out the natural gas. A system of injection and collector holes is drilled to do this.

A number of factors will determine the profitability of gas production from coalbeds. For example, the actual gas content, the pressure in the coalbed, the presence of water, and the "penetrability" all affect how much gas can be recovered and at what cost. A fracturing pattern inside a coalbed, called "cleavage," is one factor that determines the in-place penetrability. Cleavage and stratification can ease the flow of gases and fluids inside a coalbed.

For example, a coalbed with a low gas content and a high hydrostatic pressure on the desorption isotherm requires extra production of water for every unit of produced methane. Similarly, gas recovery from a coalbed with a very low penetrability requires intense destruction. In many cases, efficient gas recovery is not possible because appropriate production-enhancement technologies do not exist.

The drilling-in of a borehole in a coalbed causes a localized pressure relief and produces a pressure gradient as the methane flows to the output. A diffusion flux is generated through the coal matrix with a laminar flow through fractures the coalbed around the borehole. Ground water is pumped out to reduce the coalbed pressure enough so the gas can desorb from the coal. The faster the water removal, the faster will be the consequential release of the retained gas. The gas volume output that can be realized by an exhaust well is mainly determined by the penetrability or permeability of the wall and bottom faces of the borehole. Such faces behave like a filter matrix, and the important areas involved in restricting the gas flow the most are not more than a few diameters away from the exhaust well in the collector zone. Therefore, the more permeable that such immediate area around the exhaust borehole can be made, the higher will be the volume of gas produced.

Coal has an elastic nature to its solid makeup that can cause the pores in it to close or restrict gas permeation when subjected to large pressure gradients. The pressure gradients are highest immediately around the exhaust well borehole, and the "filter" area at the perimeter radius is minimum. The pressure isobaric curves form concentric cylindrical zones around the core. Those farther from the exhaust well inside faces have the larger surface areas. The pressure gradients are greatest immediate to the exhaust well inside faces, and the surfaces areas are minimum. The combination closes the gas pores and limits permeability nearest the inside faces. Such observation can also be expressed mathematically.

The formula for a pressure gradient distribution in a one-dimensional radial flow from a circular supply circuit with radius $R_c$, and pressure $P_c$ to a concentric borehole with effective radius $r_b$, and face pressure $P_b$, is as follows:

$$P(r) - P_c = \frac{P_b - P_c}{\ln\left(\frac{R_c}{r_b}\right)} \ln\left(\frac{R_c}{r}\right).$$

Such describes a logarithmic pressure distribution between the supply circuit and the borehole at the center. Most of the pressure differential concentrates at the narrow band nearest the borehole. For example, for $R_c \approx 100$ meters, and $r_b \approx 0.1$ meter, more than one-third of the pressure difference is dropped across the last one meter to the borehole core. Over one-half is dropped across a zone of radius ≈3 meters. The situation is even more pronounced for boreholes with smaller radii $r_b$.

Mud filtrate and small coal particles can form a filter cake that will reduce or completely shut-down an exhaust well bore. The borehole output for the same face pressure can be considerably reduced by critical-zone pore-clogging, or colmatation. For example, it is estimated a tenfold decrease in penetrability in an area of radius 0.5 meter for $r_b \approx 0.1$ meter results in a threefold decrease in the output. If the same decrease in penetrability takes place in an only slightly larger 0.2 meter radius zone, then the output is reduced by much less than before, e.g., 40%. Therefore, a principal benefit of acoustically vibrating the inside faces of the boreholes in porous and fractured media is to increase its permeability.

SUMMARY OF THE INVENTION

It is therefore an object of the present invention to provide methods and systems for increasing the permeability of porous and fractured underground media so that gases and/or liquids can be removed.

It is a further object of the present invention to provide methods and systems for increasing the productivity of natural gas mining.

It is another object of the present invention to provide an acoustic emitter for a borehole drillstring that can be used to intensify natural gas production by increasing the permeability of the surrounding media adjacent to the exhaust wells.

Briefly, a coalbed methane production embodiment of the present invention comprises acoustic radiators strategically placed within exhaust boreholes that sonically vibrate the immediate wall areas. The gas volume output that can be realized by an exhaust well is mainly determined by the penetrability of the inside faces of the borehole. Such inside faces behave like a filter matrix, and the important areas involved in restricting the gas flow the most are not more than a few diameters away from the exhaust well in the collector zone. Therefore, the more permeable that such immediate area around the exhaust borehole can be made, the higher will be the volume of gas produced. Strong sonic vibrations from the acoustic radiators positioned in a drillstring shake-open spaces in the media for the gas to flow out and be collected. The media experiences a type of elastic collapse under the differential pressures that are exerted the strongest near the borehole opening.

An advantage of the present invention is a system is provided for intensifying natural gas production from a coalbed.

Another advantage of the present invention is a natural gas intensification method is provided that is reliable, easy to build, easy to use, economical, and safe in explosive atmospheres.

These and other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENT

Figure 1:
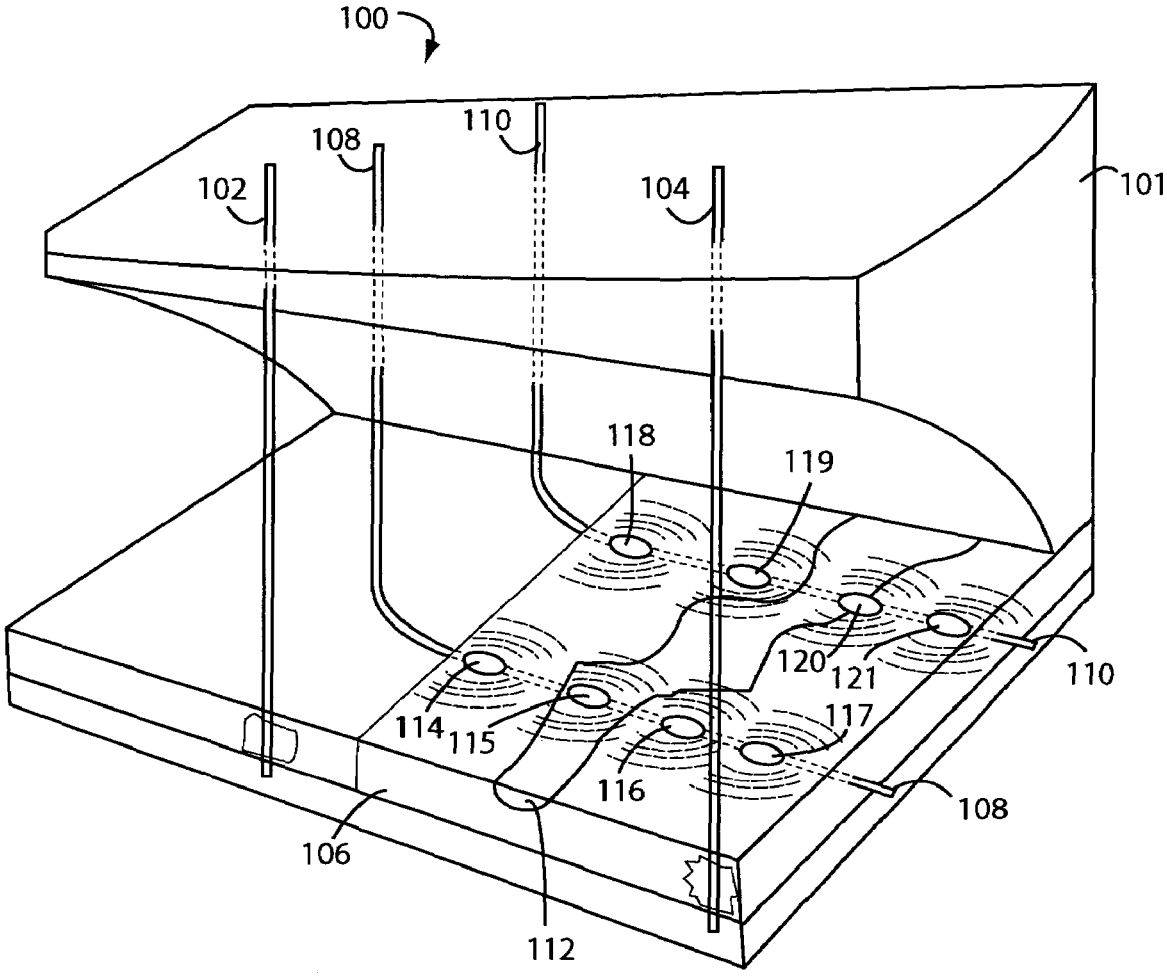
FIG. 1 is a cutaway perspective diagram of an underground coal deposit that is being drained of its natural gas with an acoustic emitter embodiment of the present invention that stimulates improved permeability of the media immediately around the exhaust well boreholes.

FIG. 1 represents a coalbed deposit mining operation for natural gas, and is referred to herein by the general reference numeral 100. A pair of exploratory vertical boreholes 102 and 104 have been drilled from the ground surface to allow for electronic sensors that can imagine and characterize a coalbed 106. A pair of directional drillstrings 108 and 110 have been used to first bore vertically to the right depth and then horizontally into the coalbed 106. A paleochannel 112 comprising sandstone represents a typical flaw or anomaly in the coal in the coalbed 106.

The coalbed 106 has naturally occurring adsorbed natural gas, which is sometimes referred to as firedamp by coal miners. It may also be swamped with groundwater. The depth of the deposit and any groundwater will pressurize the natural gas adsorbed by the coal. The drillstrings 108 and 110 can be used to remove the groundwater and vent any gas pressure. Such will promote desorption and the drillstrings 108 and 110 and their boreholes are used exhaust the natural gas.

The drillstrings 108 and 110 are fitted with acoustic emitters 114-121 and pressurizing pumps. Pneumatic or hydraulic pressure flows are sent down drillstrings 108 and 110 so the acoustic emitters 114-121 will whistle loudly. Such sound vibrations shake the coal media and increase gas permeability especially near the boreholes. Increased desorption flows result that can be exhausted and sold as methane or natural gas.

The loud whistling from each emitter can be used in a phased array to focus or concentrate sound energy. In such case, the emitters are placed within sound of each other. Otherwise, they are spaced far apart to lengthen their zone of effect along the drillstring.

Embodiments of the present invention are useful to degasify coalbeds with borehole acoustic equipment. In particular, subjecting the near-hole area to strong sound waves improves the penetrability of the media to natural gas. These further include equipment for injecting a second gas into coalbed in order to drive out the desorbing methane.

The choice of what kind of acoustic emitters 114-121 to use and how to couple their sound output into the surrounding media are practical challenges that are overcome by the present invention. Electrically operated emitters are dangerous because they can spark an explosion of the very gas being extracted. Connecting them and fitting them with an adequate power source is also problematic. Not placing the emitters in direct contact with the solid inside faces of the boreholes can result in poor acoustic impedance matching, and all the benefits can be lost because strong enough vibrations do not reach the media.

Multiple acoustic radiators 114-117, for example, can be mounted on pipe drillstring 108 at critical points and with critical frequency outputs compared to each other so as to produce a phasing of outputs extend or intensify the media zone in which the permeability is increased so the gases or liquids can be removed.

Mechanical sound radiators not powered by electricity are attractive in this application. Two basic types of mechanical sound radiators can be used, e.g., sirens which have moving parts, and whistles which have no moving parts. Moving and rubbing elements are unavoidable in the design of a siren. Sirens are difficult to manufacture, operate, and maintain. The whistle works by causing the smooth flow of air to be split by a narrow blade, e.g., a "fipple", creating a turbulent vortex which causes the air to vibrate. By attaching a resonant chamber to the basic whistle, it may be tuned to a particular note and made louder. The length of the chamber typically defines the resonant frequency. A whistle may also contain a small light ball, usually called a "pea", which rattles around inside, creating a chaotic vibrato effect that intensifies the sound.

Whistles are therefore preferred herein because they need not have any moving parts, can easily be coupled together in strings with pipe sections, can be designed for air or liquid operation, are self-cleaning, and cannot themselves provide a source of ignition of the natural gas.

Figure 2:
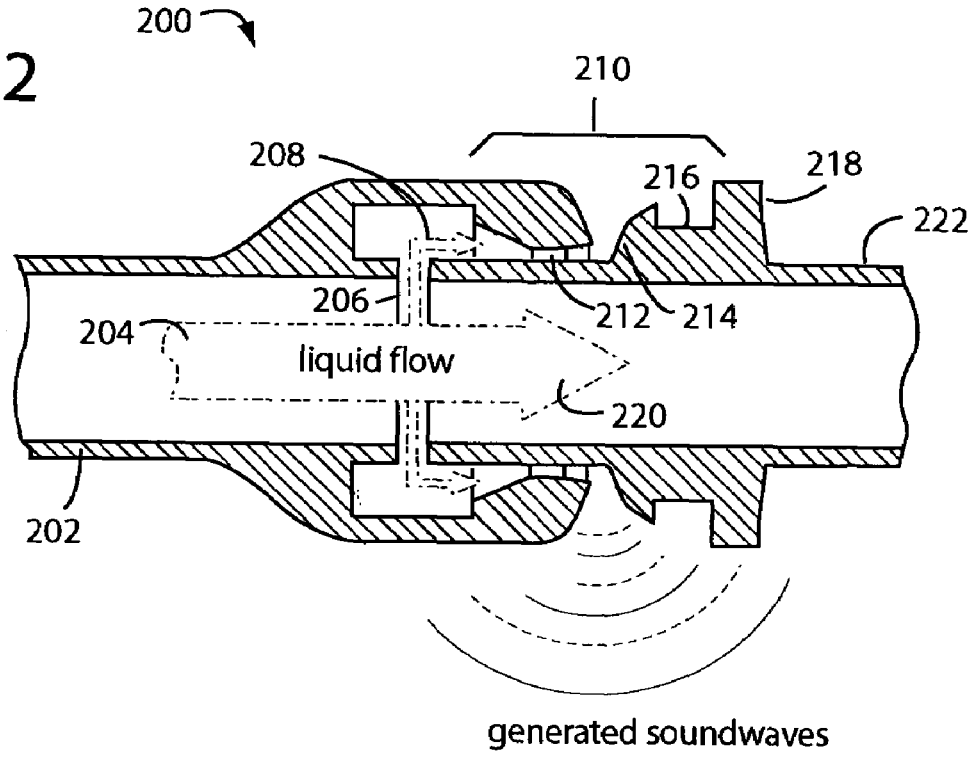
FIG. 2 is a cross-sectional diagram of a hydraulic liquid-whistle type acoustic emitter embodiment of the present invention that could be used in the system shown in FIG. 1.

FIG. 2 represents a hydraulic liquid-whistle type acoustic emitter embodiment of the present invention that could be used in the system shown in FIG. 1, and is referred to herein by the general reference numeral 200. The acoustic emitter 200 comprises an upstream pipe coupling 202 to receive a pressurized hydraulic flow 204, e.g., water obtained from the coalbed itself. A side vent 206 allow a portion 208 of the pressurized hydraulic flow to escape. A whistle 210 connected to the side vent converts the pressure and escaping flow 208 into resonances and therefore sound waves at a particular audible frequency. The whistle 210 comprises an annular nozzle 212, a ring fluting 214, an annular rabbetting 216, and a raised ring fender 218. A downstream pipe coupling 220 is used to pass along a remaining pressurized hydraulic flow 222 to a next section of pipe.

The side vent flow 208 jets out through nozzle 212 at subsonic velocity. A couple of different designs could be used here. In a first design, the jet is directed toward a vibrating plate that can resonate. Such oscillations can generate strong acoustic energy into the surrounding medium. Unfortunately, vibrating elements such as this fatigue and fail rather rapidly. The better design is shown in FIG. 2 where the liquid jet from nozzle 212 is directed toward a shaped sounding edge that can produce an unstable cavitation cloud. Such shaped sounding edge comprises ring fluting 214 and a resonant cavity formed by annular rabbetting 216 and raised ring fender 218. Pulsations are emitted by the cavitation cloud can produce strong acoustic oscillations. The development of an acoustic borehole emitter based on such a fluid whistle seems optimal for the case of processing of the near-hole area of an small-diameter exhaust borehole for coal-coalbed degasification, in particular, in the case where the hole is filled with a gas-fluid mixture.

Referring to FIG. 2, fluid upstream is supplied under pressure to the nozzle from the water main. The fluid flowing out from the nozzle has a certain velocity encounters the fillet 214. The Bernoulli effect will cause the flow to be partially deflected toward the ring-rabbet area 216. Here the local pressure is approximately equal to the vapor pressure of the fluid. A toroidal localized cavitation takes shape in the ring rabbet zone. This cavity is bounded from the outside by an elastic envelope in the form of the jet flowing past the rabbet. Material in the cavity is pulse ejected into the surrounding medium, and causes the jet oscillations. The resulting disturbance of the medium will be accompanied by the developed cavitation process and will lead to generation of a complex signal comprising the fundamental tone equal to the frequency of the cavity ejections.

When an exhaust borehole is mainly filled with gas, and not liquid, the contrasting acoustic impedances between the coal and the gas in the borehole can highly attenuate the acoustic-energy coupling into the coalbed. Conventional methods have used wall-lock emitters that must be in direct contact with a vertical borehole wall. But the wall-lock devices are not very practical because they require a predictable and uniform borehole wall. Such is impossible in uncased horizontal degasification boreholes because the borehole cross-section profiles are squashed by lithostatic pressures, and become irregular due to the low rupture stress of the coal. So reliable acoustic contact cannot be reasonably expected.

A suitable gas-medium whistle is the Hartmann radiator type. Hartmann-type emitters generate acoustic oscillations by directing supersonic gas jets from nozzles into resonating cavities. The Hartmann-type radiator is an acoustic emitter with a simple structure that is near ideal in typical borehole conditions. Such acoustic transformer will radiate its acoustic energy directly into the surrounding gas. The small coefficient of transmission of the acoustic field into the gas can be compensated for by the high specific power possible from such type acoustic emitter. It is expected that an acoustic power flux of at least 0.03 watts/cm$^2$ will be needed for the desired effects.

The output frequency of a borehole acoustic emitter should correspond to the natural resonant frequency of the borehole itself. A typical borehole is about three inches in diameter, and the elastic-wave speeds in coalbeds are about 1500-2000 meters/second for $c_1$, and 1000-1500 meters/second for $c_t$. Therefore, a frequency in the 1-5 kilohertz band is indicated. The acoustic impedance of a gas-liquid mixture, as well as a pure gas, is much less than the acoustic impedance of a coal, so the frequency estimates are valid for both cases.

One of the earliest shock wave radiators was developed by J. Hartmann. [See "On the Production of Acoustic Waves by Means of an Air Jet of a Velocity Exceeding that of Sound," Phil Mag. (7) 11, pp 926-948, 1931; and "Hartmann Acoustic Radiator," Engineering 142, p 491, (1936)]. This well-known gas-operated sonic radiator, commonly referred to as the "Hartmann" radiator. Such uses pressurized air, e.g., at 100 psi, to create a gas jet directed into a cavity resonator. This creates a sonic output pressure wave in the surrounding air. The Hartmann radiator efficiency improves as a source of sonic energy if it is operated at relatively high input gas pressures.

Figure 3:
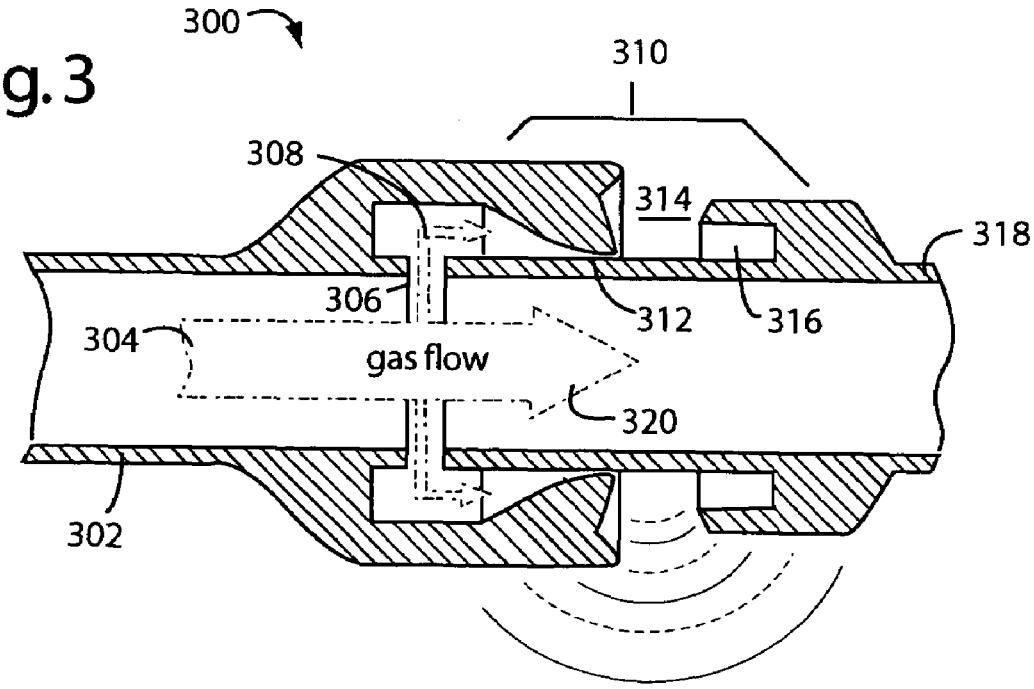
FIG. 3 is a cross-sectional diagram of a pneumatic gas-whistle type acoustic emitter embodiment of the present invention that could be used in the system shown in FIG. 1.

FIG. 3 represents a pneumatic gas-whistle type acoustic emitter embodiment of the present invention that could be used in the system shown in FIG. 1, and is referred to herein by the general reference numeral 300. The acoustic emitter 300 comprises an upstream pipe coupling 302 to receive a pressurized gas flow 304, e.g., compressed air. A side vent 306 allows a portion 308 of the pressurized airflow to escape. A whistle 310 connected to the side vent converts the pressure and escaping gas flow 308 into resonances and therefore sound waves at a particular audible frequency. The whistle 310 comprises an annular nozzle 312, a ring throat 314, and a resonant ring cavity 316. A downstream pipe coupling 318 is used to pass along a remaining pressurized hydraulic flow 320 to a next downstream section of pipe.

Although the present invention has been described in terms of the presently preferred embodiments, it is to be understood that the disclosure is not to be interpreted as limiting. Various alterations and modifications will no doubt become apparent to those skilled in the art after having read the above disclosure. Embodiments of the present invention are not limited to coalbeds, methane production, or even boreholes. The general invention is to acoustically stimulate porous or fractured underground to make it more permeable. Increased permeability allows increased gas and/or liquid extractions. Accordingly, it is intended that the appended claims be interpreted as covering all alterations and modifications as fall within the "true" spirit and scope of the invention.

What is claimed is:

1. A method for increasing the permeability of porous and fractured media subjected to pressure differentials, comprising:

venting a porous or fractured media to remove gases or liquids;

placing an acoustic radiator in a vent;

driving said acoustic radiator hydraulically or pneumatically to cause said acoustic radiator to whistle;

coupling whistle vibrations into said media such that its permeability is increased; and extracting said gases or liquids from said media.

2. A method of methane production in a coalbed, comprising:

drilling a borehole into a coalbed deposit with adsorbed natural gas;

disposing within said borehole at least one sonic acoustical radiator; and operating said sonic acoustical radiators to generate sound waves which vibrate the inside faces of said borehole and the immediate adjacent coalbed media;

wherein, said vibrations increase the permeability of said inside faces of said borehole and the immediate adjacent coalbed media and result in an increase in the exhaust of natural gas from said coalbed.

3. The method of claim 2, further comprising:

placing a drillstring in said borehole that includes a plurality of said sonic acoustical radiators positioned along its length.

4. The method of claim 2, further comprising:

including a whistle in each of said sonic acoustical radiators that is activated in the step of operating by forcing a flow down the borehole to said whistle.

5. The method of claim 2, wherein:

the step of operating includes sending a pressurized hydraulic or pneumatic flow to said sonic acoustical radiators that resonates to produce said sound waves at a particular audible frequency.

6. A system for increasing the material removal flowrates of hydrocarbon gases or liquids from porous and fractured media in underground deposits, comprising:

an exhaust well borehole drilled into an underground deposit, wherein drilling has been completed;

a drillstring pipe for disposal in the exhaust well borehole after drilling is complete, and providing for the extraction of hydrocarbon gases or liquids from any porous and fractured media surrounding the exhaust well borehole;

an acoustic radiator mounted on the drillstring pipe such that when the drillstring pipe is disposed in the exhaust well borehole, the first acoustic radiator will be positioned proximate to expected deposits of said hydrocarbon gases or liquids in said porous and fractured media surrounding the exhaust well borehole;

a hydraulic or pneumatic flow that is forced down the pipe during operation to power a whistling of the acoustic radiator;

wherein, whistle vibrations coupled into said media which cause the permeability of the porous and fractured media surrounding the exhaust well borehole to be increased such that said hydrocarbon gases or liquids flow more readily into the drillstring pipe from said underground deposit.

7. The system of claim 6, further comprising:

additional acoustic radiators mounted on the drillstring pipe at intervals that together extend the zone in which the permeability is increased so said hydrocarbon gases or liquids can be removed.

8. The device of claim 6, further comprising:

another acoustic radiator mounted on the drillstring pipe at a critical point and with a critical frequency output compared to the other acoustic radiator to produce a phasing of outputs that extend or intensify the zone in which the permeability is increased so said hydrocarbon gases or liquids can be removed.

* * * * *